US011412334B2

(12) United States Patent
Andersson

(10) Patent No.: US 11,412,334 B2
(45) Date of Patent: Aug. 9, 2022

(54) CONTRALATERAL SOUND CAPTURE WITH RESPECT TO STIMULATION ENERGY SOURCE

(71) Applicant: Cochlear Limited, Macquarie University (AU)

(72) Inventor: Marcus Andersson, Gothenburg (SE)

(73) Assignee: Cochlear Limited, Macquarie University (AU)

( * ) Notice: Subject to any disclaimer, the term of this patent is extended or adjusted under 35 U.S.C. 154(b) by 637 days.

(21) Appl. No.: 14/061,410

(22) Filed: Oct. 23, 2013

(65) Prior Publication Data

US 2015/0110322 A1 Apr. 23, 2015

(51) Int. Cl.
*H04R 25/00* (2006.01)

(52) U.S. Cl.
CPC ..... *H04R 25/552* (2013.01); *H04R 25/606* (2013.01); *H04R 25/607* (2019.05); *H04R 2460/13* (2013.01)

(58) Field of Classification Search
CPC ..... H04R 2225/021; H04R 2225/53; H04R 2225/67; H04R 2460/13; H04R 25/43
USPC ..... 381/326, 328, 380, 151, 330, 315–317, 381/23.1, 381; 600/625; 607/137, 57
See application file for complete search history.

(56) References Cited

U.S. PATENT DOCUMENTS 4,736,747 A 4/1988 Drake
4,791,673 A * 12/1988 Schreiber ..... H04R 1/1075 381/330
5,784,478 A * 7/1998 Untersander ..... 381/151
5,949,895 A 9/1999 Ball et al.
6,084,975 A * 7/2000 Perkins ..... H04R 25/606 381/312
6,148,087 A * 11/2000 Martin ..... G02C 5/143 381/23.1
6,342,035 B1 * 1/2002 Kroll ..... H04R 25/606 600/25
6,389,142 B1 * 5/2002 Hagen ..... H04R 25/407 381/313
7,043,040 B2 * 5/2006 Westerkull ..... H04R 25/606 381/181

(Continued)

FOREIGN PATENT DOCUMENTS

DE 20 2004 006 117 U1 8/2004
DE 10 2006 026 288 A1 1/2007

(Continued)

OTHER PUBLICATIONS

"Transcript of Jay T. Rubinstein," Mar. 29, 2018, Patent Trial & Appeal Board, IPR2017-01018, *Oticon Medical AB et al.* v. *Cochlear Bone Anchored Solutions AB*.

*Primary Examiner* — Fan S Tsang
*Assistant Examiner* — Julie X Dang
(74) *Attorney, Agent, or Firm* — Pilloff Passino & Cosenza LLP; Martin J. Cosenza

(57) ABSTRACT

A hearing prosthesis system, including a sound capture device configured to capture a sound and generate a signal based on the captured sound, and a vibratory portion configured to vibrate in response to the signal to evoke a hearing percept via bone conduction, wherein the system is configured to capture the sound on a first side of a recipient where the sound capture device is located and transfer the signal to a second side of the recipient where the vibratory portion is located.

16 Claims, 13 Drawing Sheets

(56) References Cited

U.S. PATENT DOCUMENTS 7,722,524 B2 5/2010 Lupin et al.
7,881,800 B2 2/2011 Daly et al.
8,233,651 B1 * 7/2012 Haller ..... A61N 1/36036 381/318
8,929,566 B2 * 1/2015 Kaulberg ..... G10L 21/038 381/98
2002/0012441 A1 * 1/2002 Matsunaga ..... A42B 1/245 381/381
2003/0031336 A1 2/2003 Harrison et al.
2004/0032962 A1 * 2/2004 Westerkull ..... H04R 25/606 381/151
2004/0202339 A1 * 10/2004 O'Brien, Jr. ..... H04B 13/005 381/312
2004/0234091 A1 * 11/2004 Westerkull ..... H04R 25/606 381/328
2005/0033384 A1 * 2/2005 Sacha ..... A61N 1/36032 607/57
2006/0050914 A1 * 3/2006 Urso ..... H04R 25/656 381/328
2006/0056649 A1 * 3/2006 Schumaier ..... H04R 25/606 381/326
2007/0041595 A1 * 2/2007 Carazo ..... H04R 17/00 381/151
2007/0053536 A1 3/2007 Westerkull
2007/0249889 A1 10/2007 Hanson et al.
2008/0009918 A1 1/2008 Zierhofer et al.
2008/0112581 A1 * 5/2008 Kim ..... H04R 1/1075 381/151
2008/0195179 A1 * 8/2008 Quick ..... A61B 5/121 607/57
2009/0052698 A1 * 2/2009 Rader ..... H04R 25/606 381/151
2009/0154739 A1 * 6/2009 Zellner ..... H04R 1/1041 381/311
2009/0196444 A1 * 8/2009 Solum ..... H01Q 1/241 381/315
2009/0209806 A1 8/2009 Hakansson
2009/0245557 A1 * 10/2009 Parker ..... H04R 25/70 381/326
2009/0290721 A1 * 11/2009 Goldstein ..... H04R 1/1083 381/74
2009/0304210 A1 * 12/2009 Weisman ..... H04R 1/1083 381/151
2010/0030012 A1 * 2/2010 Meskens ..... A61N 1/36032 600/25
2010/0067725 A1 * 3/2010 Schumaier ..... H04R 25/456 381/330
2010/0137675 A1 * 6/2010 Parker ..... H04R 25/606 600/25
2010/0260364 A1 * 10/2010 Merks ..... H04R 25/407 381/313
2011/0015466 A1 * 1/2011 Waldmann ..... H04R 25/554 600/25
2011/0019838 A1 * 1/2011 Kaulberg ..... H04R 25/43 381/98
2011/0026748 A1 * 2/2011 Parker ..... 381/326
2011/0093039 A1 * 4/2011 Van Den Heuvel ..... A61N 1/36032 607/57
2011/0130622 A1 * 6/2011 Llberg ..... A61N 1/36032 600/25
2011/0235833 A1 * 9/2011 Hensen ..... H04R 5/033 381/311
2011/0301404 A1 * 12/2011 Bern ..... H04R 25/606 600/25
2011/0301729 A1 * 12/2011 Heiman ..... H04S 7/301 700/94
2011/0319703 A1 * 12/2011 Wiskerke ..... H04R 25/30 600/25
2012/0095283 A1 * 4/2012 Andersson ..... H04R 25/606 600/25
2012/0237067 A1 * 9/2012 Asnes ..... 381/326
2012/0300965 A1 * 11/2012 Samuels ..... H04R 25/00 381/328
2012/0303093 A1 * 11/2012 Wouters ..... A61N 1/0541 607/57
2013/0051566 A1 * 2/2013 Pontoppidan ..... H04R 25/353 381/23.1
2013/0114834 A1 * 5/2013 Bern ..... H04R 25/606 381/151
2013/0150657 A1 * 6/2013 Leigh ..... H04R 25/606 600/25
2013/0156262 A1 * 6/2013 Taguchi ..... G06T 7/0046 382/103
2013/0216078 A1 * 8/2013 Bewley ..... H04R 25/556 381/322
2014/0064531 A1 3/2014 Andersson et al.
2014/0211957 A1 * 7/2014 Bologna ..... H04R 3/002 381/74
2014/0270291 A1 * 9/2014 Flynn ..... H04R 25/70 381/318

FOREIGN PATENT DOCUMENTS

DK 56794 A 11/1995
EP 2302953 A2 3/2011
WO 01/93635 A1 12/2001
WO 2010/111547 A1 9/2010
WO 2010/131360 A1 11/2010

* cited by examiner

CONTRALATERAL SOUND CAPTURE WITH RESPECT TO STIMULATION ENERGY SOURCE

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc, or for individuals who suffer from stuttering problems.

SUMMARY

In accordance with one aspect, there is a hearing prosthesis system, comprising a sound capture device configured to capture a sound and generate a signal based on the captured sound and a vibratory portion configured to vibrate in response to the signal to evoke a hearing percept via bone conduction, wherein the system is configured to capture the sound on a first side of a recipient where the sound capture device is located and transfer the signal to a second side of the recipient where the vibratory portion is located.

In accordance with another aspect, there is a hearing prosthesis system as described above and/or below, wherein the system is configured to evoke hearing percepts via bone conduction at only high-frequencies.

In accordance with another aspect, there is a method comprising capturing sound at a first side of a recipient, and evoking a hearing percept via bone conduction with energy originating on an opposite side of the recipient based on the captured sound.

In accordance with another aspect, there is a method as described above and/or below, wherein the evoked hearing percept via bone conduction is evoked utilizing a vibrator, and the hearing percept evoked by vibrating the tympanic membrane results from the vibrator.

In accordance with another aspect, there is a method, comprising imparting vibratory energy into bone proximate an at least partially functioning cochlea of a recipient based on sound captured on a side of the recipient opposite the at least partially functioning cochlea; and evoking a hearing percept via bone conduction due to the imparted vibratory energy.

In accordance with another aspect, there is a behind-the-ear device, comprising a vibratory portion configured to vibrate in response to an audio signal to evoke a hearing percept via bone conduction, and a speaker portion configured to evoke a hearing percept via an acoustic pressure wave, wherein the behind-the-ear device is a totally external device.

In accordance with another aspect, there is a behind-the-ear device as described above and/or below, wherein the device is configured to receive a wireless signal originating from a component remote from the device, wherein the wireless signal corresponds to the audio signal.

In accordance with another aspect, there is a method comprising imparting vibratory energy into bone proximate an at least partially functioning cochlea of a recipient based on sound captured on a side of the recipient opposite the at least partially functioning cochlea; and evoking a hearing percept due to the imparted vibratory energy.

In accordance with another aspect, there is a method as detailed above and/or below, wherein the at least partially functioning cochlea is an effectively fully functioning cochlea. In accordance with another aspect, there is a method as detailed above and/or below, wherein a cochlea of the recipient on the side of the recipient opposite the at least partially functioning cochlea is less functional than the at least partially functioning cochlea. In accordance with another aspect, there is a method as detailed above and/or below, wherein the evoked hearing percept via bone conduction is based on ambient sound having high frequency.

In accordance with another aspect, there is a method as detailed above and/or below, wherein the evoked hearing percept via bone conduction does not evoke a hearing percept corresponding to a low frequency. In accordance with another aspect, there is a method as detailed above and/or below, wherein the evoked hearing percept via bone conduction is evoked utilizing a device configured to not evoke a hearing percept corresponding to a low frequency.

BRIEF DESCRIPTION OF THE DRAWINGS

Some embodiments are described below with reference to the attached drawings, in which.

DETAILED DESCRIPTION

Figure 1A:
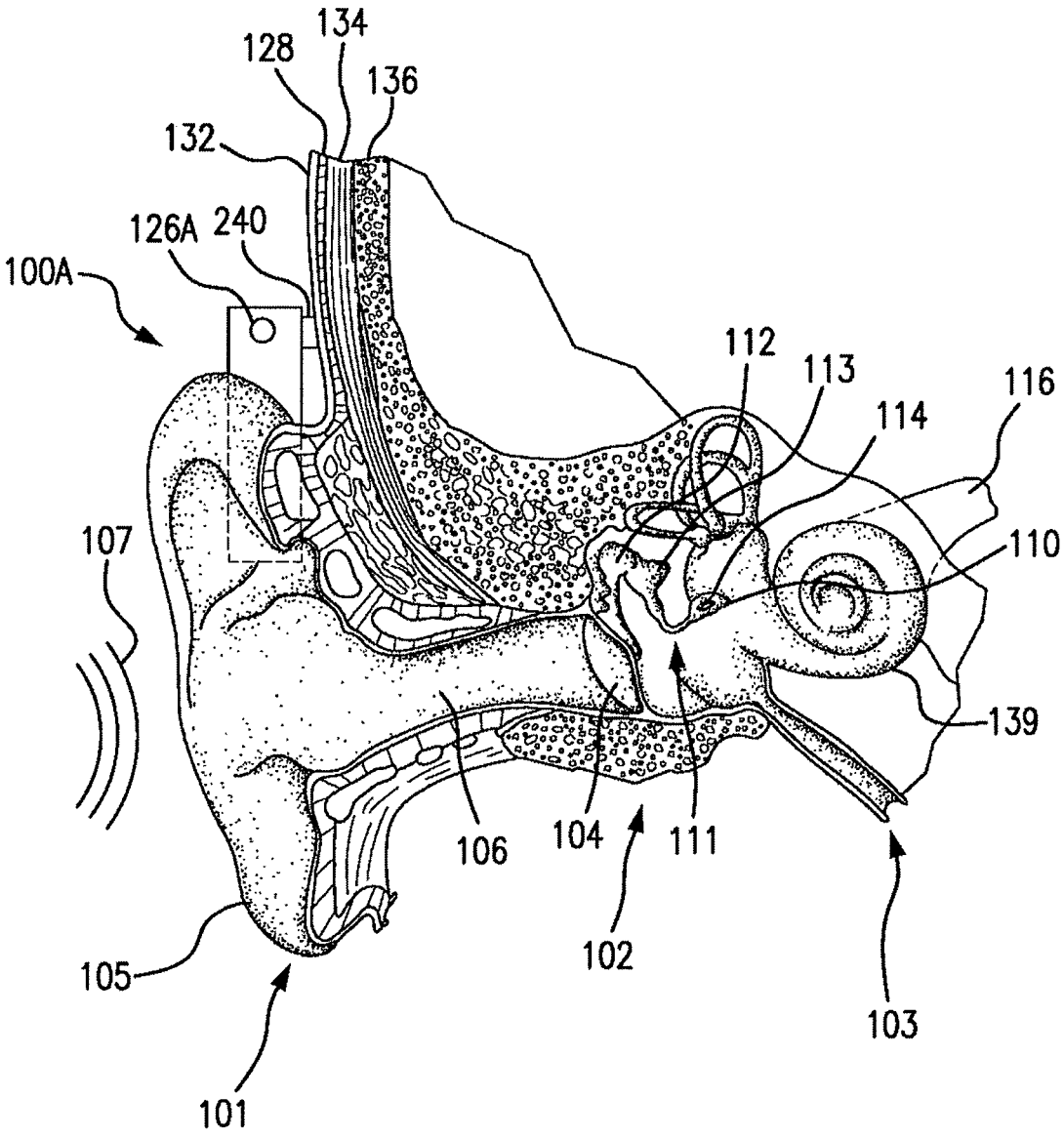
FIG. 1A is a perspective view of an exemplary bone conduction device in which at least some embodiments can be implemented.

FIG. 1A is a perspective view of a bone conduction device 100A in which embodiments may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1A also illustrates the positioning of bone conduction device 100A relative to outer ear 101, middle ear 102 and inner ear 103 of a recipient of device 100. As shown, bone conduction device 100 is positioned behind outer ear 101 of the recipient and comprises a sound input element 126A to receive sound signals. Sound input element may comprise, for example, a microphone, telecoil, etc. In an exemplary embodiment, sound input element 126A may be located, for example, on or in bone conduction device 100A, or on a cable extending from bone conduction device 100A.

In an exemplary embodiment, bone conduction device 100A comprises an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100A. Such releasable coupling is accomplished via a coupling assembly of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or other type of actuator (not shown—which are sometimes referred to herein as a species of the genus vibrator) and/or various other operational components, such as sound input device 126A. In this regard, the operationally removable component is sometimes referred to herein as a vibrator unit. More particularly, sound input device 126A (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, the operationally removable component of the bone conduction device 100A further includes a coupling assembly 240 configured to operationally removably attach the operationally removable component to a bone conduction implant (also referred to as an anchor system and/or a fixation system) which is implanted in the recipient. In the embodiment of FIG. 1, coupling assembly 240 is coupled to the bone conduction implant (not shown) implanted in the recipient in a manner that is further detailed below with respect to exemplary embodiments of the bone conduction implant. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128 and skin 232 so that the coupling assembly may be attached thereto. Such a percutaneous abutment provides an attachment location for the coupling assembly that facilitates efficient transmission of mechanical force.

It is noted that while many of the details of the embodiments presented herein are described with respect to a percutaneous bone conduction device, some or all of the teachings disclosed herein may be utilized in transcutaneous bone conduction devices and/or other devices that utilize a vibrating electromagnetic actuator. For example, embodiments include active transcutaneous bone conduction systems utilizing the electromagnetic actuators disclosed herein and variations thereof where at least one active component (e.g. the electromagnetic actuator) is implanted beneath the skin. Embodiments also include passive transcutaneous bone conduction systems utilizing the electromagnetic actuators disclosed herein and variations thereof where no active component (e.g., the electromagnetic actuator) is implanted beneath the skin (it is instead located in an external device), and the implantable part is, for instance a magnetic pressure plate. Some embodiments of the passive transcutaneous bone conduction systems are configured for use where the vibrator (located in an external device) containing the electromagnetic actuator is held in place by pressing the vibrator against the skin of the recipient. In an exemplary embodiment, an implantable holding assembly is implanted in the recipient that is configured to press the bone conduction device against the skin of the recipient. In other embodiments, the vibrator is held against the skin via a magnetic coupling (magnetic material and/or magnets being implanted in the recipient and the vibrator having a magnet and/or magnetic material to complete the magnetic circuit, thereby coupling the vibrator to the recipient).

Figure 1B:
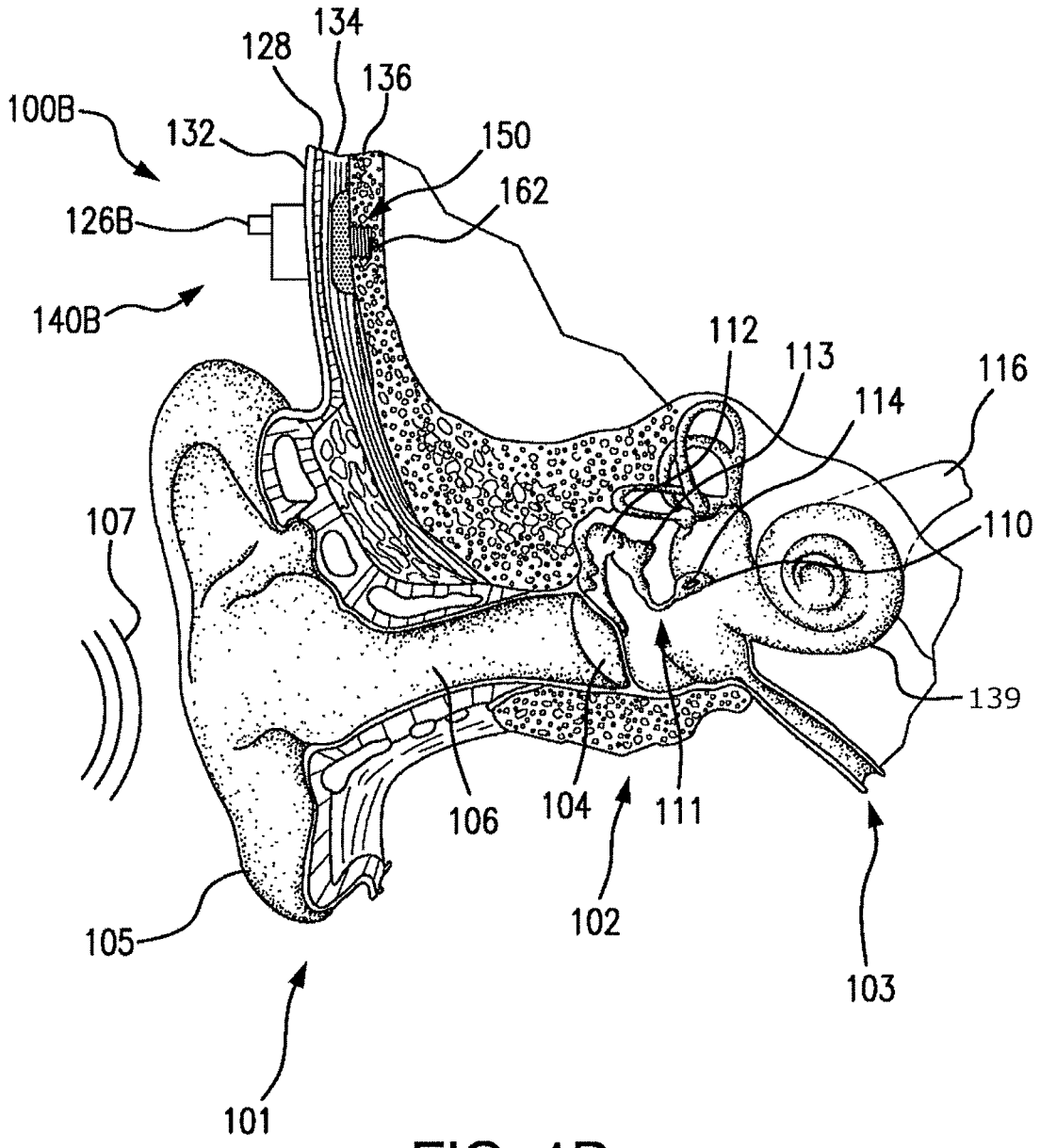
FIG. 1B is a perspective view of an alternate exemplary bone conduction device in which at least some embodiments can be implemented.

More specifically, FIG. 1B is a perspective view of a transcutaneous bone conduction device 100B in which embodiments can be implemented.

FIG. 1A also illustrates the positioning of bone conduction device 100B relative to outer ear 101, middle ear 102 and inner ear 103 of a recipient of device 100. As shown, bone conduction device 100 is positioned behind outer ear 101 of the recipient. Bone conduction device 100B comprises an external component 140B and implantable component 150. The bone conduction device 100B includes a sound input element 126B to receive sound signals. As with sound input element 126A, sound input element 126B may comprise, for example, a microphone, telecoil, etc. In an exemplary embodiment, sound input element 126B may be located, for example, on or in bone conduction device 100B, on a cable or tube extending from bone conduction device 100B, etc. Alternatively, sound input element 126B may be subcutaneously implanted in the recipient, or positioned in the recipient's ear. Sound input element 126B may also be a component that receives an electronic signal indicative of sound, such as, for example, from an external audio device. For example, sound input element 126B may receive a sound signal in the form of an electrical signal from an MP3 player electronically connected to sound input element 126B.

Bone conduction device 100B comprises a sound processor (not shown), an actuator (also not shown) and/or various other operational components. In operation, sound input device 126B converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B can be a passive transcutaneous bone conduction device. That is, no active components, such as the actuator, are implanted beneath the recipient's skin 132. In such an arrangement, the active actuator is located in external component 140B, and implantable component 150 includes a magnetic plate, as will be discussed in greater detail below. The magnetic plate of the implantable component 150 vibrates in response to vibration transmitted through the skin, mechanically and/or via a magnetic field, that are generated by an external magnetic plate.

In another arrangement of FIG. 1B, bone conduction device 100B can be an active transcutaneous bone conduction device where at least one active component, such as the actuator, is implanted beneath the recipient's skin 132 and is thus part of the implantable component 150. As described below, in such an arrangement, external component 140B may comprise a sound processor and transmitter, while implantable component 150 may comprise a signal receiver and/or various other electronic circuits/devices.

Figure 1C:
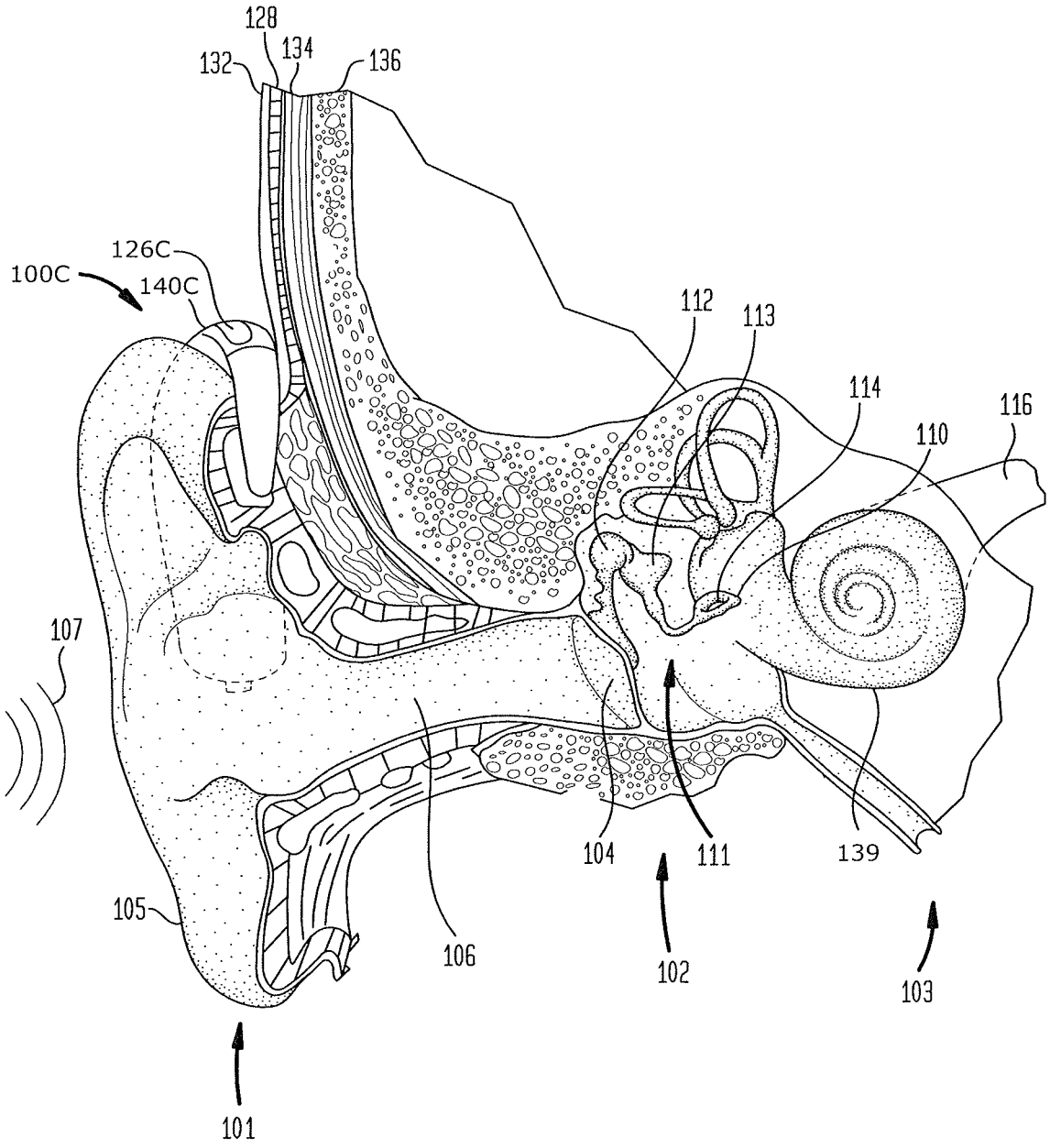
FIG. 1C is a perspective view of an alternate exemplary bone conduction device in which at least some embodiments can be implemented.

FIG. 1C is a perspective view of a transcutaneous bone conduction device 100C in which embodiments of the present invention can be implemented, worn by a recipient. As shown, bone conduction device 100C is positioned behind outer ear 101 of the recipient. Bone conduction device 100C comprises an external component 140C in the form of a behind-the-ear (BTE) device.

External component 140C typically comprises one or more sound input elements 126C, such as a microphone, for detecting and capturing sound, a sound processing unit (not shown) and a power source (not shown). The external component 140C includes an actuator (not shown), which in the embodiment of FIG. 1C, is located within the body of the BTE device, although in other embodiments, the actuator may be located remote from the BTE device (or other component of the external component 140C having a sound input element, a sound processing unit and/or a power source, etc.).

The sound processing unit of the external component 140C processes the output of the sound input element 126C, which is typically in the form of an electrical signal. The processing unit generates control signals that cause the actuator to vibrate. In other words, the actuator converts the electrical signals into mechanical vibrations for delivery to the recipient's skull.

As noted above, with respect to the embodiment of FIG. 1C, bone conduction device 100C is a passive transcutaneous bone conduction device. That is, no active components, such as the actuator, are implanted beneath the recipient's skin 132. In such an arrangement, as will be described below, the active actuator is located in external component 140. The embodiment of FIG. 1C is depicted as having no implantable component. That is, vibrations generated by the actuator are transferred from the actuator, into the skin directly from the actuator and/or through a housing of the BTE device, through the skin of the recipient, and into the bone of the recipient, thereby evoking a hearing percept without passing through an implantable component. In this regard, it is a totally external bone conduction device. Alternatively, in an exemplary embodiment, there is an implantable component that includes a plate or other applicable component, as will be discussed in greater detail below. The plate or other component of the implantable component vibrates in response to vibration transmitted through the skin.

Figure 2:
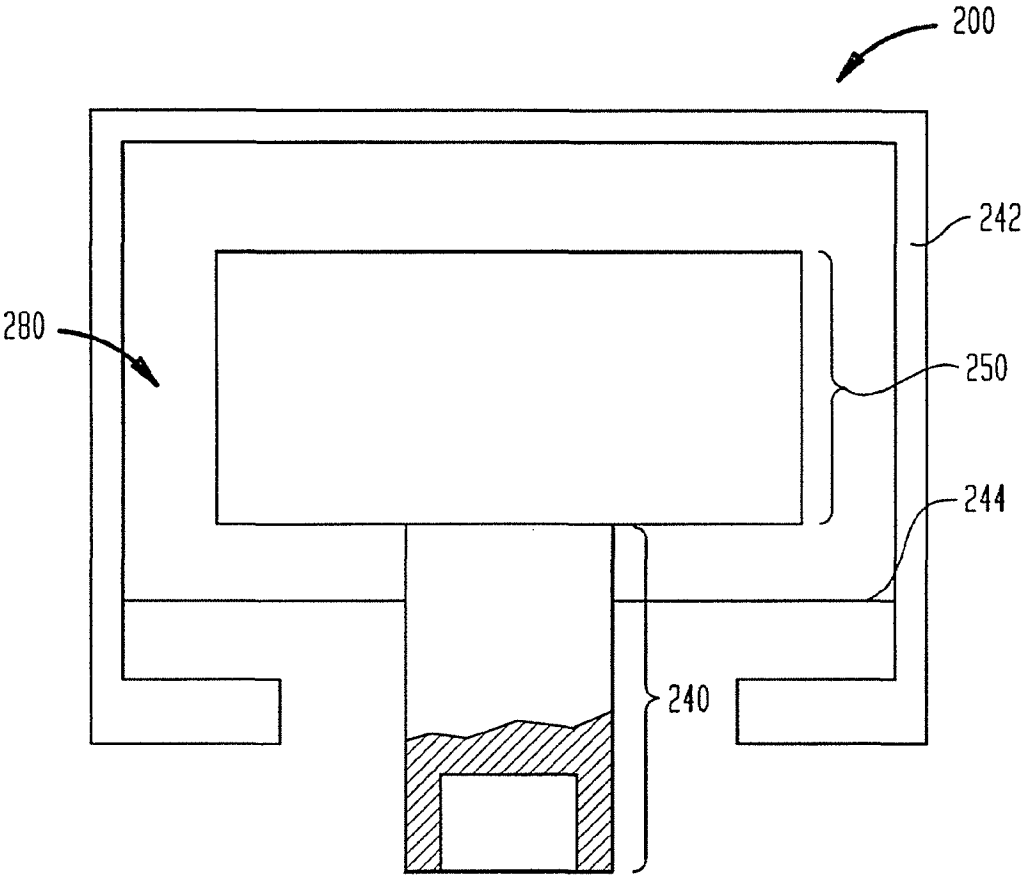
FIG. 2 is a schematic diagram conceptually illustrating a removable component of a percutaneous bone conduction device in accordance with at least some exemplary embodiments.

FIG. 2 is an embodiment of a bone conduction device 200 in accordance with an embodiment corresponding to that of FIG. 1A, illustrating use of a percutaneous bone conduction device. Bone conduction device 200, corresponding to, for example, element 100A of FIG. 1A, includes a housing 242, a vibrating electromagnetic actuator 250, a coupling assembly 240 that extends from housing 242 and is mechanically linked to vibrating electromagnetic actuator 250. Collectively, vibrating electromagnetic actuator 250 and coupling assembly 240 form a vibrating electromagnetic actuator-coupling assembly 280. Vibrating electromagnetic actuator-coupling assembly 280 is suspended in housing 242 by spring 244. In an exemplary embodiment, spring 244 is connected to coupling assembly 240, and vibrating electromagnetic actuator 250 is supported by coupling assembly 240. It is noted that while embodiments are detailed herein that utilize a spring, alternate embodiments can utilize other types of resilient elements. Accordingly, unless otherwise noted, disclosure of a spring herein also includes disclosure of any other type of resilient element that can be utilized to practice the respective embodiment and/or variations thereof.

Figure 3:
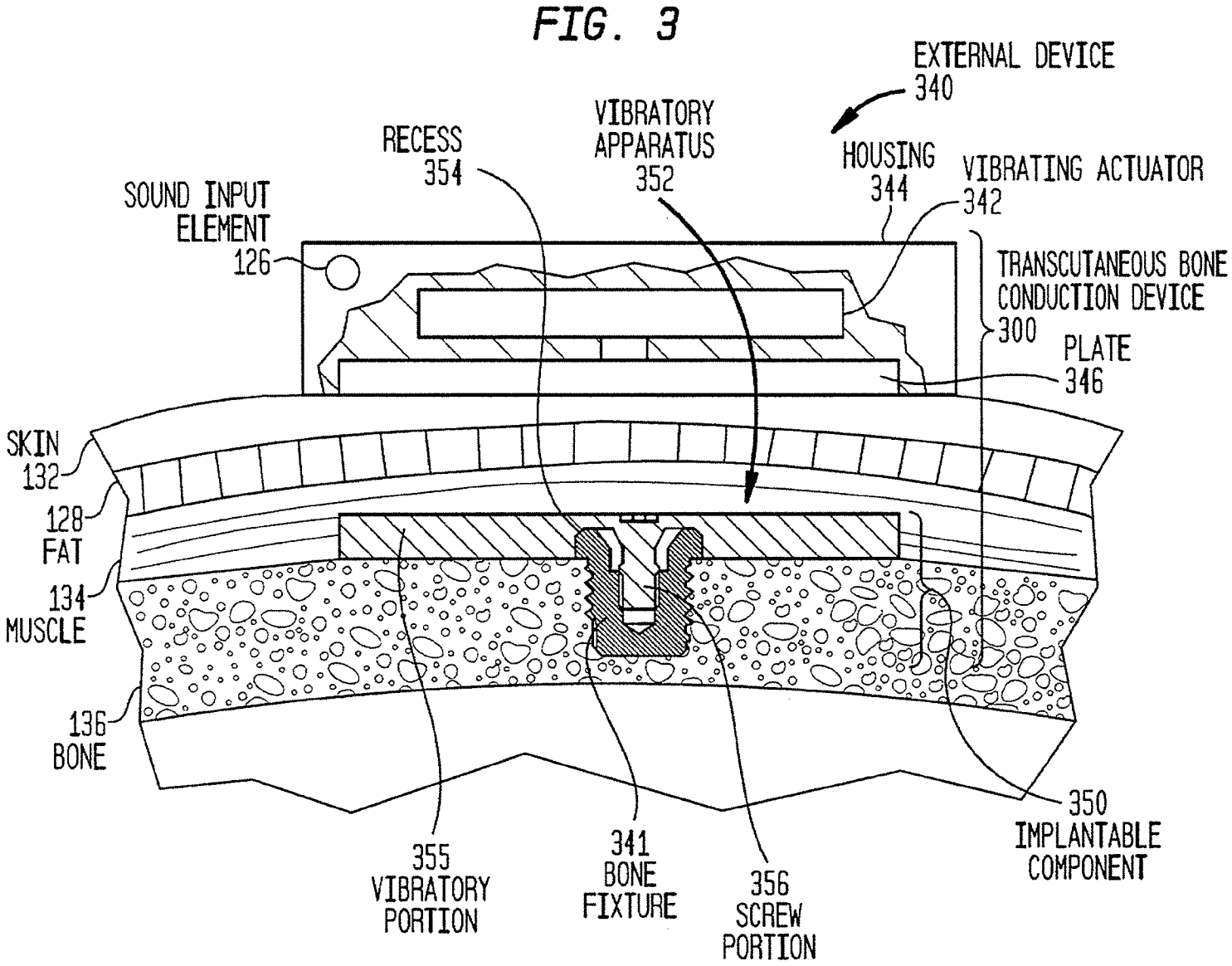
FIG. 3 is a schematic diagram conceptually illustrating a passive transcutaneous bone conduction device in accordance with at least some exemplary embodiments.

FIG. 3 depicts an exemplary embodiment of a transcutaneous bone conduction device 300 according to an embodiment that includes an external device 340 (corresponding to, for example, element 140B of FIG. 1B) and an implantable component 350 (corresponding to, for example, element 150 of FIG. 1B). The transcutaneous bone conduction device 300 of FIG. 3 is a passive transcutaneous bone conduction device in that a vibrating electromagnetic actuator 342 is located in the external device 340. Vibrating electromagnetic actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating electromagnetic actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating electromagnetic actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating electromagnetic actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object such as an abutment as detailed herein with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 4:
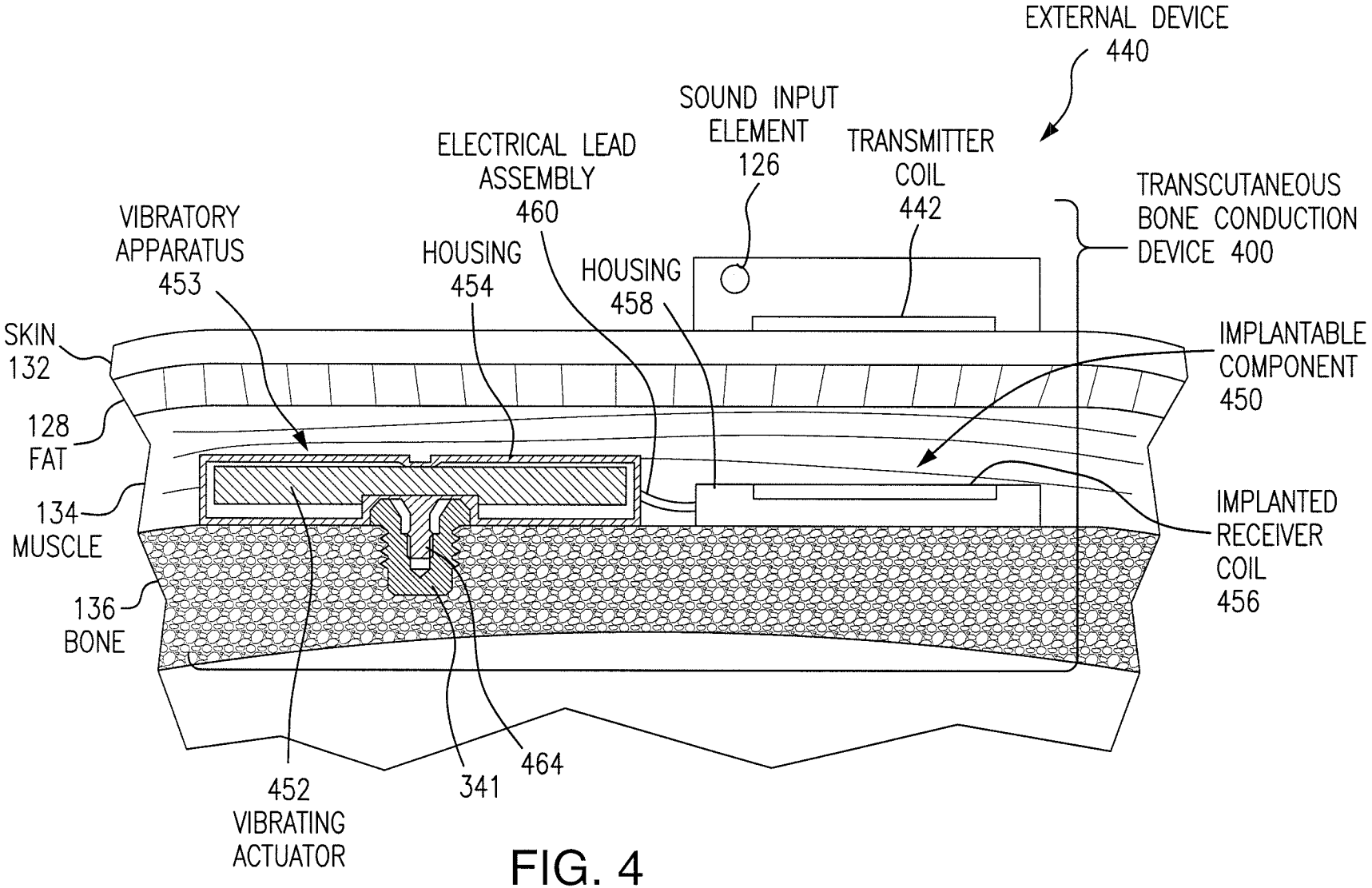
FIG. 4 is a schematic diagram conceptually illustrating an active transcutaneous bone conduction device in accordance with at least some exemplary embodiments.

FIG. 4 depicts an exemplary embodiment of a transcutaneous bone conduction device 400 according to another embodiment that includes an external device 440 (corresponding to, for example, element 140B of FIG. 1B) and an implantable component 450 (corresponding to, for example, element 150 of FIG. 1B). The transcutaneous bone conduction device 400 of FIG. 4 is an active transcutaneous bone conduction device in that the vibrating electromagnetic actuator 452 is located in the implantable component 450. Specifically, a vibratory element in the form of vibrating electromagnetic actuator 452 is located in housing 454 of the implantable component 450. In an exemplary embodiment, much like the vibrating electromagnetic actuator 342 described above with respect to transcutaneous bone conduction device 300, the vibrating electromagnetic actuator 452 is a device that converts electrical signals into vibration.

External component 440 includes a sound input element 126 that converts sound into electrical signals. Specifically, the transcutaneous bone conduction device 400 provides these electrical signals to vibrating electromagnetic actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. Components (not shown) in the housing 458, such as, for example, a signal generator or an implanted sound processor, then generate electrical signals to be delivered to vibrating electromagnetic actuator 452 via electrical lead assembly 460. The vibrating electromagnetic actuator 452 converts the electrical signals into vibrations.

The vibrating electromagnetic actuator 452 is mechanically coupled to the housing 454. Housing 454 and vibrating electromagnetic actuator 452 collectively form a vibratory apparatus 453. The housing 454 is substantially rigidly attached to bone fixture 341.

Figure 5A:
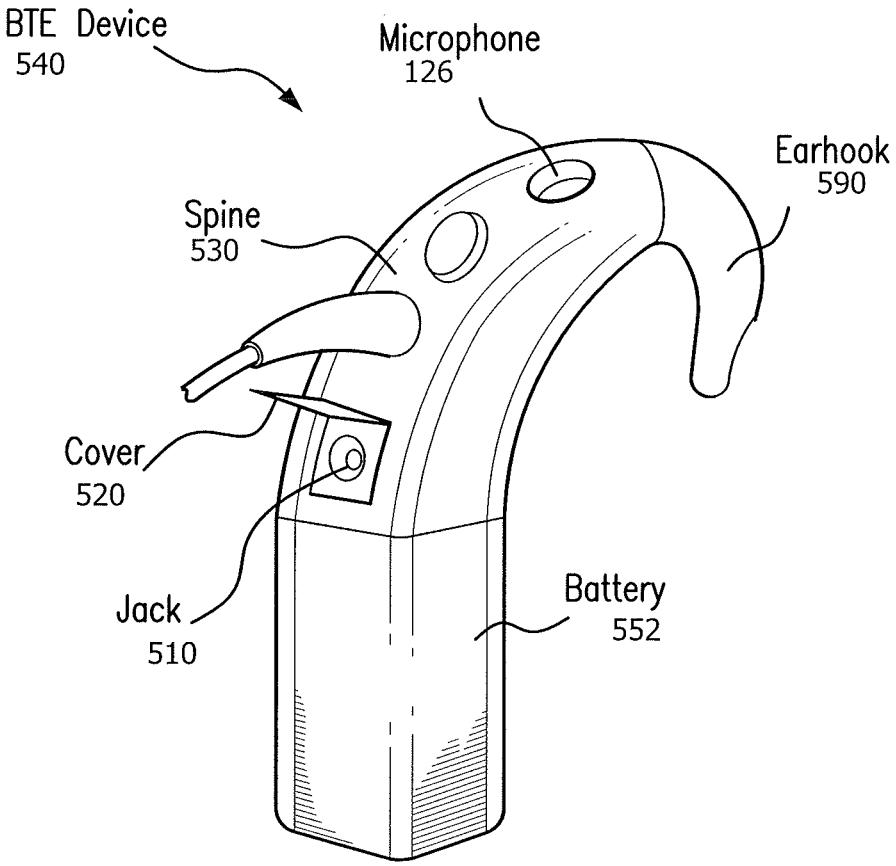
FIG. 5A is a schematic diagram conceptually illustrating a behind-the-ear (BTE) device corresponding to a passive transcutaneous bone conduction device.
Figure 5B:
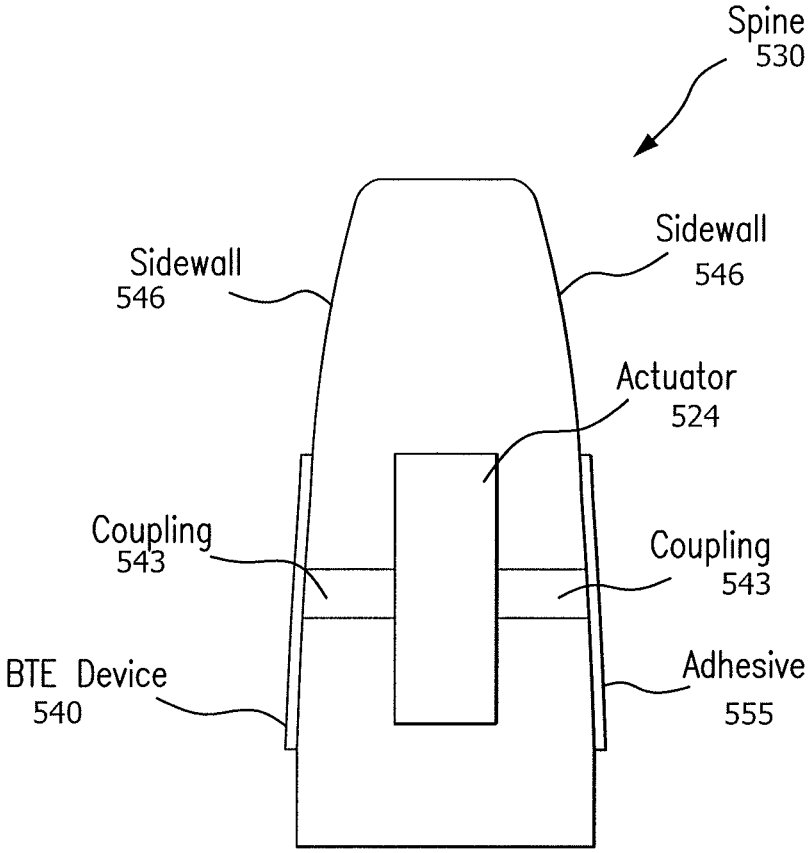
FIG. 5B is a schematic diagram conceptually illustrating a rear view of a portion of the behind-the-ear (BTE) device of FIG. 5B.

Referring now to FIG. 5A, there is a device 540 in the form of a behind-the-ear device, corresponding to the device 140C described above in FIG. 1C. BTE device 540 includes one or more microphones 126, and may further include an audio signal jack 510 under a cover 520 on the spine 530 of BTE device 540. FIG. 5A further depicts battery 552 and ear hook 590 removably attached to spine 530. FIG. 5B is a rear perspective view of the spine 530 of the BTE device 540.

In an exemplary embodiment, the BTE device 540 includes a vibratory apparatus configured to evoke a hearing percept via passive transcutaneous bone conduction. Actuator 542 is shown located within the spine 330 of BTE device 542. Actuator 542 is a vibratory apparatus, and can be an electromagnetic actuator and/or a piezoelectric actuator and/or another type of actuator that can enable bone conduction. Actuator 542 is coupled to the sidewalls 546 of the spine 530 via couplings 543 which are configured to (i) transfer vibrations generated by actuator 542 to the sidewalls 546, from which those vibrations are transferred to skin 132. In some embodiments, the sidewalls 546 form at least part of a housing of spine 530. In some embodiments, the housing hermetically seals the interior of the spine 530 from the external environment.

FIG. 5B depicts adhesives 555 located on the sidewalls 546 of the BTE device 540. Adhesives 555 form coupling portions that are respectively configured to removably adhere the BTE device 540 to the recipient via adhesion at the locations of the adhesives 555. This adherence being in addition to that which might be provided by the presence of the earhook 590 and/or any grasping phenomenon resulting from the auricle 105 of the outer ear and the skin overlying the mastoid bone of the recipient.

It is noted that the embodiment of FIG. 5B is depicted with adhesives 555 located on both sides of the BTE device. In an exemplary embodiment of this embodiment, this permits the adherence properties detailed herein and/or variations thereof to be achieved regardless of whether the recipient wears the BTE device on the left side (in accordance with that depicted in FIG. 5A) or the right side (or wears two BTE devices). In an alternate embodiment, BTE device 540 includes adhesive only on one side (the side appropriate for the side on which the recipient intends to wear the BTE device 540). An embodiment of a BTE device includes a dual-side compatible BTE bone conduction device, as will be detailed below.

The adhesives 555 are depicted in FIG. 5B in an exaggerated manner so as to be more easily identified. In an exemplary embodiment, the adhesives 555 are double sided tape, where one side of the tape is protected by a barrier, such as a silicone paper, that is removed from the skin-side of the double-sided tape in relatively close temporal proximity to the placement of the BTE device 540 on the recipient. In an exemplary embodiment, adhesives 555 are glue or the like. In an exemplary embodiment where the adhesives 555 are glue, the glue may be applied in relatively close temporal proximity to the placement of the BTE device 540 on the recipient. Such application may be applied by the recipient to the spine 530, in an exemplary embodiment.

As will be further detailed below, various teachings detailed herein and/or variations thereof can be applicable to the various embodiments of FIGS. 2-5B and/or variations thereof. In an exemplary embodiment, the various teachings detailed herein and/or variations thereof can be applied to the various embodiments of FIGS. 2-5B to obtain a hearing prosthesis where a vibrating actuator or the like generates vibrations in response to a sound captured by sound capture devices of the various embodiments that are ultimately transmitted to bone of a recipient in a manner that at least effectively evokes hearing percept. By "effectively evokes a hearing percept," it is meant that the vibrations are such that a typical human between 18 years old and 40 years old having a fully functioning cochlea receiving such vibrations, where the vibrations communicate speech, would be able to understand the speech communicated by those vibrations in a manner sufficient to carry on a conversation provided that those adult humans are fluent in the language forming the basis of the speech. That said, it is noted that embodiments can also effectively evoke a hearing percept in humans younger than 18 years old and older than 40 years old and/or with humans without a fully functioning cochlea and/or in humans that are not completely fluent in the language forming the basis of the speech. In other words, the aforementioned population of 18 to 40 year olds is provided by way of example and not by way of limitation.

In accordance with at least some exemplary embodiments, one or more or all of the above detailed bone conduction devices and/or variations thereof can be utilized in at least some embodiments. That said, in at least some exemplary embodiments, the sound capture devices of the bone conduction devices may be arranged in a manner different than that detailed above and or additional sound capture devices may be utilized with those devices. Some exemplary embodiments that utilize these variations will be detailed below.

More specifically, some exemplary uses of these bone conduction devices will now be detailed in accordance with some exemplary embodiments. It is noted that unless otherwise specified, disclosure herein of utilization of one type of bone conduction device does not exclude utilization of any of the others. Indeed, in an exemplary embodiment, any bone conduction device detailed herein and/or variation thereof can be substituted for any specified bone conduction device that is indicated herein for use in a method, and apparatus, and/or system.

Figure 6A:
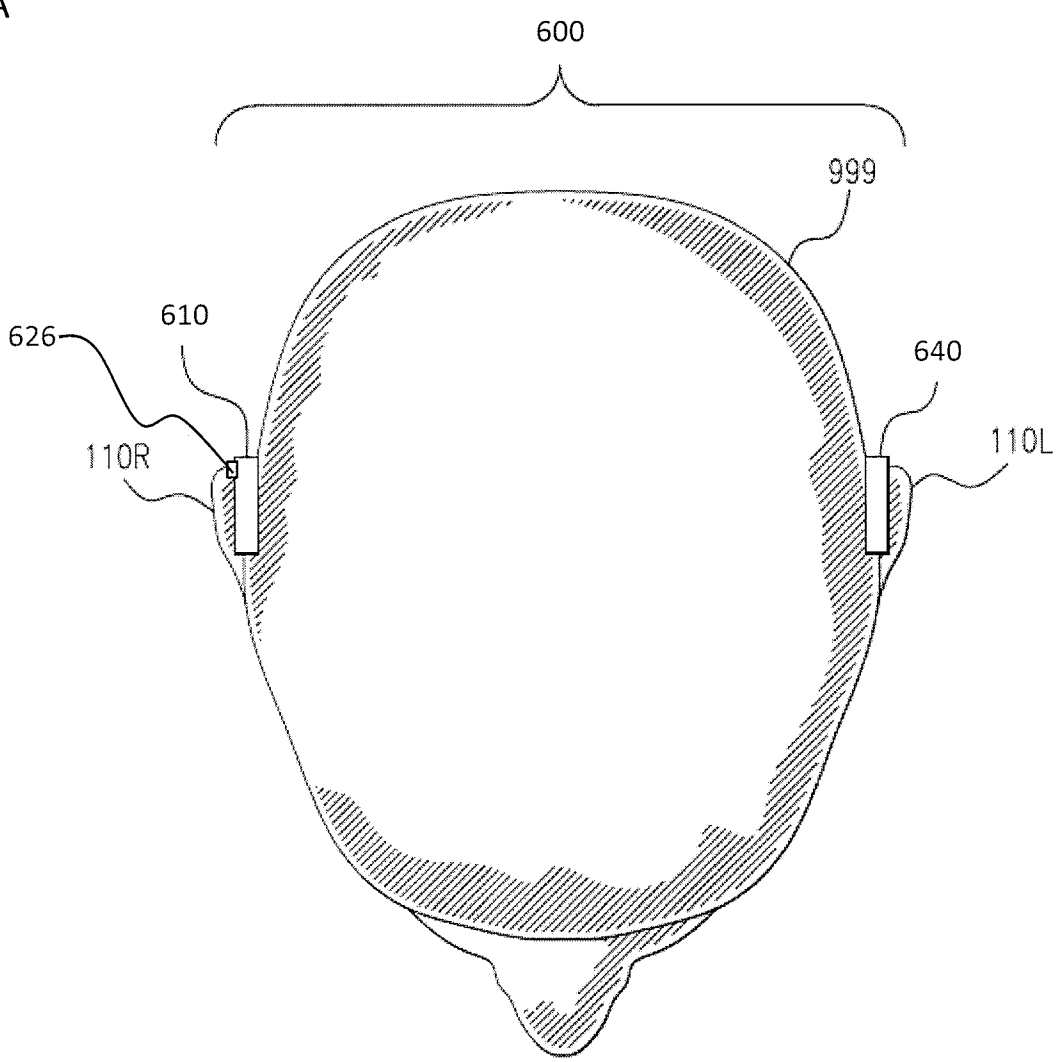
FIG. 6A is a high-level functional diagram of an exemplary embodiment.

FIG. 6A depicts a high-level functional diagram of an exemplary system 600 applied to a recipient 999 (the view is a top view—that is a view looking downward onto the recipient's head), with left and right auricle 110L and 110R, respectively. It is noted that the embodiment of FIG. 6A depicts one of many applications of the teachings detailed herein and/or variations thereof with respect to human physiology. In this regard, while the embodiment of FIG. 6A is described in terms of the utilization of two behind-the-ear devices, it is to be noted that in alternative embodiments, the teachings detailed herein and/or variations thereof can be implemented at other locations on the human body, as will be further described below.

System 600 includes a first prosthetic device 610 corresponding to a BTE device configured to capture sound. In this regard, the first prostatic device 610 includes a sound capture device 626 configured to capture sound and generate a signal based on the captured sound. According to an exemplary embodiment, the sound capture device 626 is a traditional microphone that receives sound pressure waves corresponding to an ambient noise (e.g. a speaker's voice) and transduces the sound pressure waves into an electrical signal or an optical signal, etc. System 600 also includes a second prosthetic device 640 also corresponding to a BTE device. This second device is configured to evoke a hearing percept utilizing bone conduction as the principle of operation based on the captured sound captured by the first prosthetic device 600. Accordingly, in an exemplary embodiment, the first device 610 and the second device 640 are configured to be in communication with one another (at least one way communication, although in alternate embodiments there can be two-way communication between the devices). Thus, owing to the fact that device 610 is positioned on the left side of the recipient, and device 640 is positioned on the right side of the recipient, the system 600 is configured to capture sound on a first side of the recipient and transfer a signal that is based on that captured sound to a second side the recipient where the system transduces that transferred signal or a signal based on that signal into vibratory energy to evoke a hearing percept based on bone conduction.

Figure 6B:
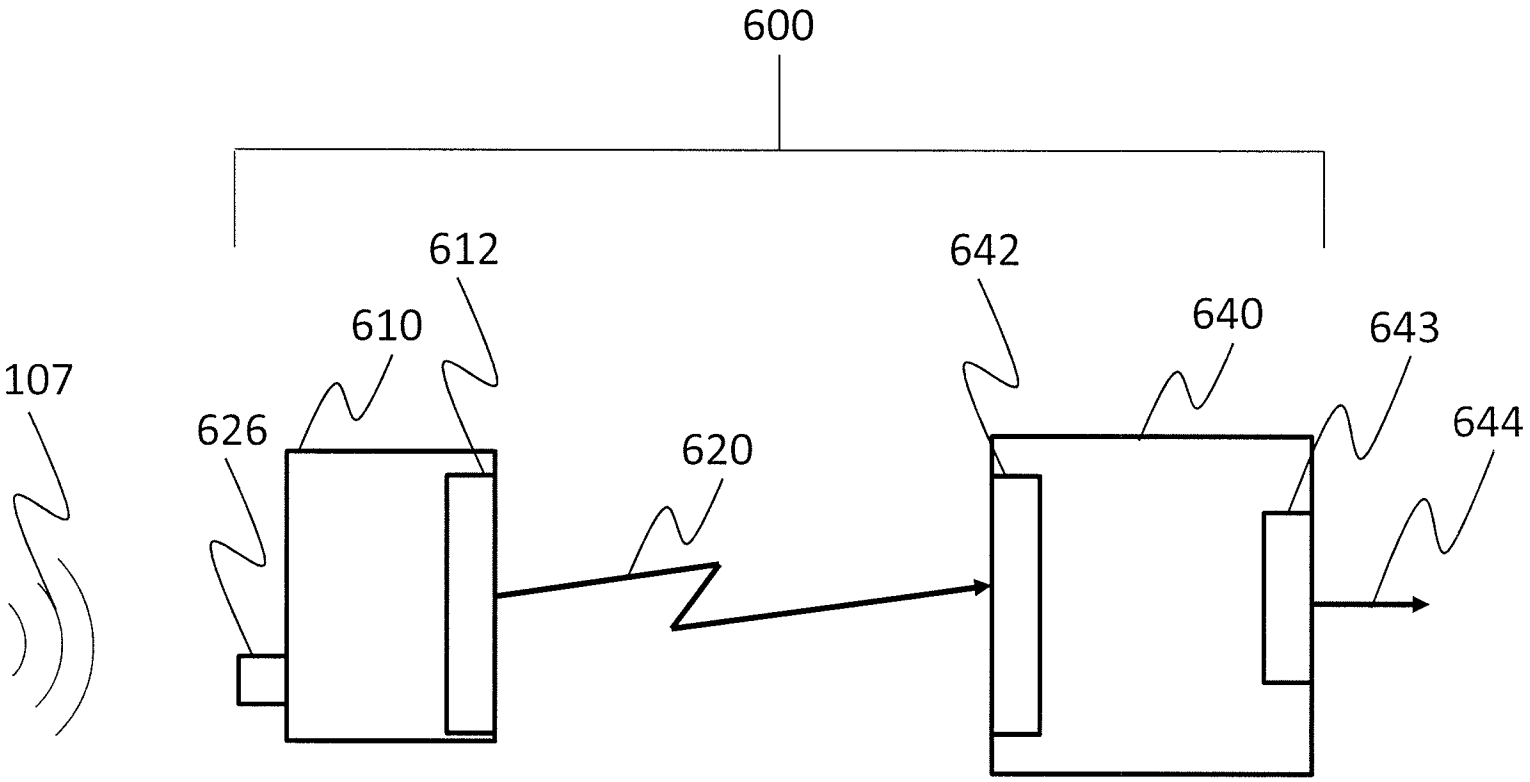
FIG. 6B is a medium-level functional diagram of an exemplary embodiment.

FIG. 6B depicts a medium-level functional diagram of the system 600 of FIG. 6A. As can be seen, ambient sound represented by signal 107 is received by the sound capture device 626 of device 610. This captured sound is transduced by device 610 (e.g., by microphone 626) and the transduced signal is provided to transmitter 612 (directly and/or indirectly—another signal based on the transduced signal can be provided to transmitter 612 in some embodiments). Device 610 outputs a signal 620 (which can be electromagnetic signal, and optical signal, or any other signal that will enable the teachings detailed herein and are variations thereof to be practiced) via transmitter 612, which is received by transmitter 642 of device 640. Device 640 utilizes the content of this signal to generate vibrational output 644 via vibrational actuator 643 to evoke a hearing percept via bone conduction in a manner corresponding to that of the bone conduction device of FIGS. 5A-B, although in other embodiments, it can be corresponding to one or more of the other or all of the bone conduction devices detailed herein and/or variations thereof. In this regard, in an exemplary embodiment, device 640 corresponds to any of the bone conduction devices detailed herein and/or variations thereof, with the exception that it includes a transmitter 642 that receives a signal indicative of sound captured by another device (instead of its own sound capture device) and uses that received signal to evoke a hearing percept based on bone conduction device.

In an alternate embodiment, system 600 further includes a signal relay which can be positioned between device 610 and device 640. More particularly, in an exemplary embodiment, there can be some scenarios where there is utilitarian value in ensuring that the signal transmitted from transmitter 612 is of relatively low-power, at least in scenarios where the signal 620 is a radio frequency signal/electromagnetic signal. In some embodiments, this low-power may not be enough to ensure that the signal 620 reaches device 640 from device 610. Accordingly, a relay can be positioned that receives the signal 620 from device 610, and transfers that signal or a new signal based on that received signal to device 640. The relay can amplify the received signal and/or subject the received signal to further signal processing prior to relaying the signal to device 640. (It is noted that the term relay includes both passing the signal through in a modified and/or unmodified state, as well as generating a new signal based on the received signal.) In an exemplary embodiment, the relay can be located on a necklace of the like located around the recipient's neck. The relay can be located at any position that can enable the teachings detailed herein and/or variations thereof to be practiced.

In an exemplary embodiment, by way of example only and not by way of limitation, devices 610 and 640 are non-invasive prosthetic devices, such as BTE devices (e.g., device 610 can correspond to a BTE device having the functionality of a sound capture device (it can have additional functionality (e.g., it can correspond to the embodiment of FIG. 1C))), and device 640 can correspond to the BTE device of FIG. 1C (with or without the sound capture device thereof), which, as noted above, corresponds to a passive transcutaneous bone conduction device where the vibratory portion that evokes a hearing percept via bone conduction is part of the BTE device. Accordingly, in an exemplary embodiment, the hearing perceives a system 600 that is a totally external hearing prosthesis system.

Alternatively, and/or in addition to this, devices 610 and/or 640 can be minimally invasive devices such as, for example, in-the-ear canal (ITE) devices (device 610 can include an in-the-ear canal sound capture device and/or device 640 can include an in-the-ear canal bone conduction device). Still further, devices 610 and 640 can be invasive devices, such as by way of example only and not by way of limitation, an implantable microphone with respect to device 610, and, with respect to device 640, any of the bone conduction devices of FIGS. 2, 3 and/or 4 or variations thereof. Alternatively, in an exemplary embodiment, device 610 can be any of the bone conduction devices of FIGS. 2, 3, 4 and/or 5A-B, where the sound capture device thereof is utilized to capture sound and the device (or an add-on device, which includes a transmitter) has the additional functionality to transmit a signal including data based on that captured sound to device 640. The vibratory component of device 610 can be disabled or otherwise inactive in at least some instances.

Device 640 can be any of the bone conduction devices of FIGS. 2, 3, 4 and/or 5A-B, and has the additional functionality to receive a signal including data based on the captured sound captured by device 610. The sound capture device of such a device can be disabled or otherwise inoperative or the output can be disregard or otherwise not used in some scenarios of use. Thus, in an exemplary embodiment, device 640 is a percutaneous bone conduction device where the vibratory portion that evokes a hearing percept via bone conduction is part of the percutaneous bone conduction device. Also, in an alternate exemplary embodiment, device 640 is an active or passive transcutaneous bone conduction device where the vibratory portion that evokes a hearing percept via bone conduction is part of the active or passive transcutaneous bone conduction device, respectively.

Any device, system, and/or method that can enable the teachings detailed herein and are variations thereof to practice can be utilized in at least some embodiments.

According to an exemplary embodiment, at least device 640, but in some alternate embodiments, both device 640 and device 610 correspond to the bone conduction device of the embodiment of FIGS. 1C/5A-B. Thus, in keeping with the above, in at least some such embodiments, the bone conduction functionality of device 610 (if device 610 corresponds to the embodiment of FIG. 1C) is disabled or otherwise does not respond to sounds captured by the respective sound capture device, and, in at least some embodiments, the sound capture functionality of device 640 (if device 640 corresponds to the embodiment of FIG. 1C) is disabled or otherwise is not utilized to evoke a hearing percept by that device (device 640). In such an exemplary embodiment, the bone conduction devices are configured to be in communication with one another (at least one way communication, although in other embodiments two way communication), in accordance with the functional diagram of FIG. 6B.

According to an exemplary embodiment, communication between device 610 and device 640 is accomplished by communication link 620 (referred to also as signal 620). In an exemplary embodiment, communication link 620 is a wireless communication link. Alternatively and/or in addition to this, communication link 620 can be a wired link (e.g. electrical leads, a fiber-optic communication system, etc.). Any device, system, and our method that will enable device 610 to communicate with device 640 to practice the teachings detailed herein and are variations thereof can be utilized in at least some embodiments.

Figure 7A:
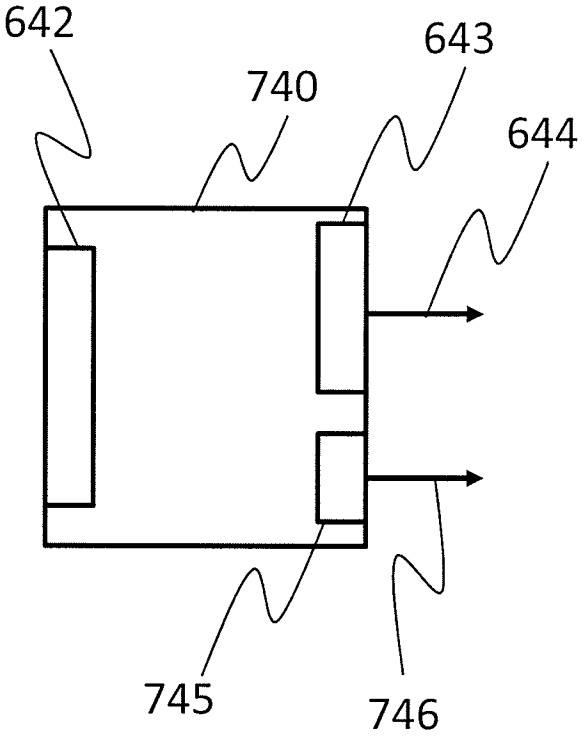
FIG. 7A is a diagram of an exemplary alternate embodiment usable with the embodiments of FIGS. 6A and 6B.

FIG. 7A depicts an alternate embodiment of a prosthetic device usable in system 600. More particularly, FIG. 7A depicts device 740, which can replace device 640 in system 600. That is, in an exemplary embodiment, there is a system 600 that corresponds to that detailed above, except that device 640 is replaced with device 740.

Device 740 can correspond to any of the bone conduction devices detailed above with respect to FIGS. 2, 3, and/or 5A-B, except that it further includes transducer 745 which corresponds to a speaker that is configured to evoke a hearing percept by an acoustic pressure wave, functionally depicted in FIG. 7A by output arrow 746. In an exemplary embodiment, the hearing percept developed by device 740 is based on the signal received over data link 620 from device 610. Thus, in an exemplary embodiment, device 740 (i) evokes a hearing percept via bone conduction utilizing vibrational actuator 643 which outputs vibration 644 to the skin of the recipient, which transmits those vibrations to the bone of the recipient and (ii) evokes a hearing percept via acoustic conduction, where an acoustic pressure wave 746 is generated by speaker 745 that, in some embodiments, impinges upon the tympanic membrane of at least one of the ears of the recipient having at least some residual normal hearing capability. This is as contrasted to bone or skin or cartilage conduction, where the vibrations are transferred through the bone, skin or cartilage, respectively.

Figure 7B:
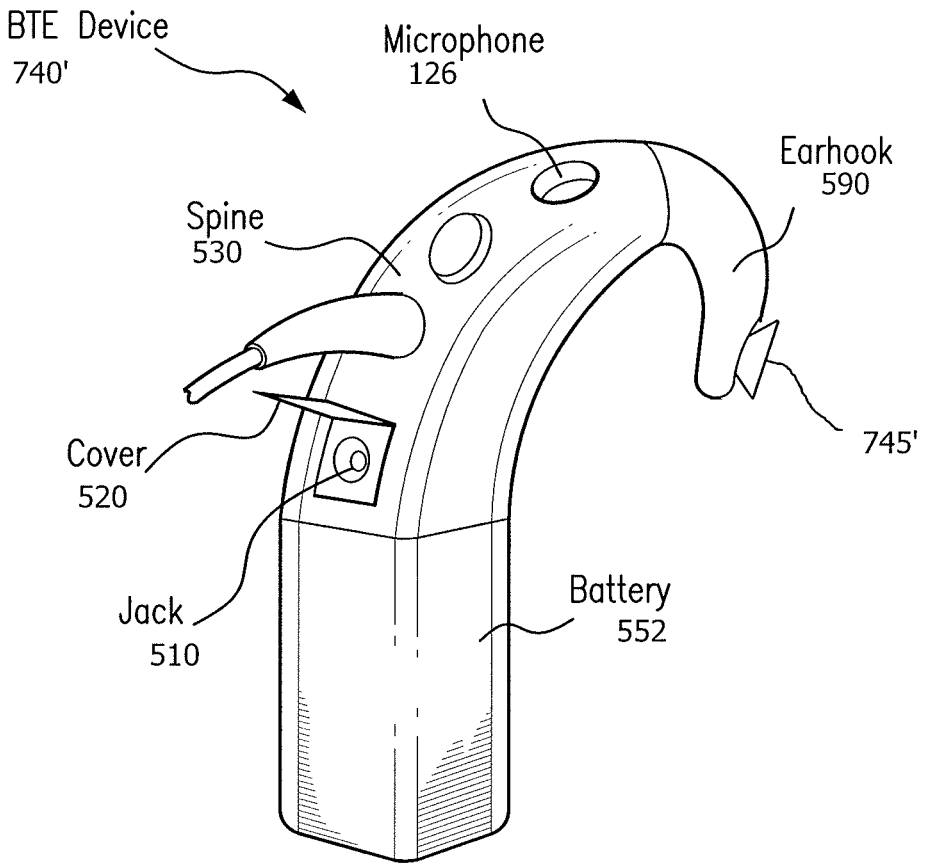
FIG. 7B is a schematic diagram conceptually illustrating an alternate behind-the-ear (BTE) device corresponding to a passive transcutaneous bone conduction device that also includes an exemplary speaker.

In an exemplary embodiment, device 740 corresponds to a BTE device. More particularly, in an exemplary embodiment, device 740 corresponds to the BTE device of FIG. 5A-B, with the additional feature of microphone 745. In this regard, FIG. 7B is a rear perspective view of an exemplary BTE device 740' corresponding to device 740. BTE device 740' includes a speaker 745' mounted at the distal portion of the earhook 790. As can be seen from FIG. 7B, the geometry of the BTE device 740' is such that the speaker 745' is located in a non-in-the-ear component of the device 740'. That is, no part of the earhook 740 and no part of the speaker 745' extends into the ear canal of the recipient. Thus, in an exemplary embodiment, the hearing percept evoked via acoustic conduction is evoked without any prosthetic component in the outer ear canal of the opposite side of the recipient. In a similar vein, in some embodiments, the speaker 745' is mounted on the spine of the BTE device and/or at another location. Still further, in some embodiments, the speaker 745' can be located on another component away from device 740 (or 640 as the case may be). Any placement of the speaker 745' that will enable the teachings detailed herein and are variations thereof to be practiced can be utilized in at least some embodiments. Further, the BTE device 740' includes circuitry configured for the operation of speaker 745' and/or other components of BTE device 740'.

Accordingly, in an exemplary embodiment, there is a BTE device, such as BTE device 740', comprising a vibratory portion configured to vibrate in response to an audio signal to evoke a hearing percept via bone conduction. In an exemplary embodiment, this audio signal is provided from a remote sound capture device, such as a device configured to be located on an opposite side of the recipient from where the BTE device is located, consistent with the teachings herein and/or variations thereof. Alternatively and/or in addition to this, the audio signal is provided by a sound capture device that is part of the BTE device. The BTE device further includes a speaker portion configured to evoke a hearing percept via an acoustic pressure wave. In an exemplary embodiment, the BTE device is a totally external device in that it is configured to evoke a hearing percept via bone conduction and configured to evoke a hearing percept via acoustic conduction without a component entering or otherwise being positioned within an orifice of the recipient (e.g., no speaker located in the ear canal of the recipient, no component implanted subcutaneously or percutaneously, etc.) Indeed, in an exemplary embodiment, the BTE device is a device that does not include an in-the-ear component/the BTE speaker is located on a non-in-the-ear component of the BTE device (e.g., the ear hook, a temple mount (which can be on or part of the ear hook, etc.).

Some exemplary performance/functional features of the system 600 and/or variations thereof will now be detailed, along with some exemplary methods of utilizing such systems and/or variations thereof.

Figure 8:
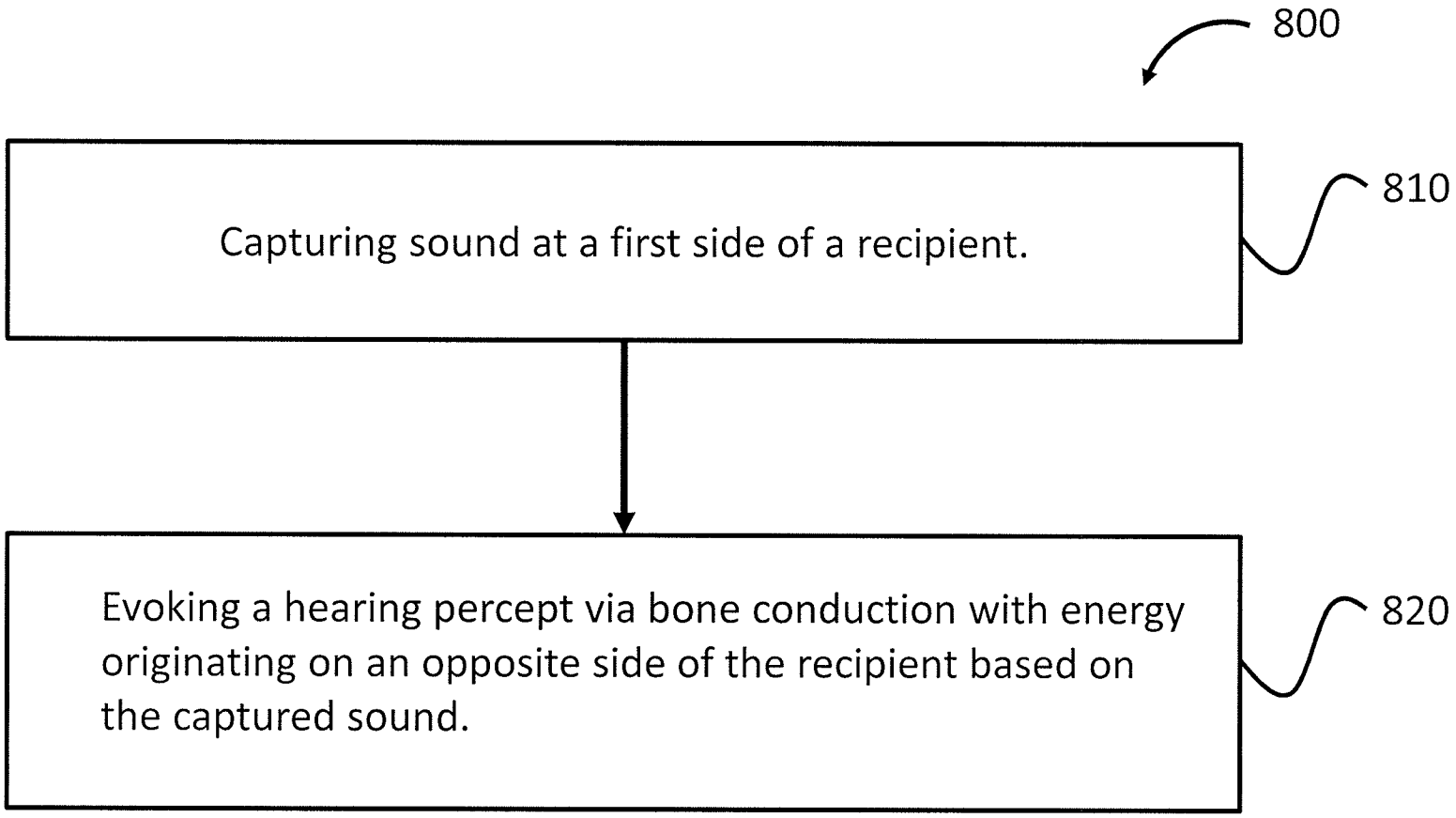
FIG. 8 is an exemplary flow chart of an exemplary method according to an exemplary embodiment.

Referring now to FIG. 8, there is an exemplary flowchart 800 for an exemplary method of utilizing system 600, although it is noted that the methods detailed herein and are variations thereof can be practiced utilizing other devices or systems. Any device or system that can be utilized to execute any method detailed herein and/or variation thereof can be utilized in at least some embodiments. Still further, it is noted that any disclosure herein of a device or system includes the disclosure of any method of utilizing that device and/or system, just as any disclosure of a method herein includes the disclosure of a device and/or system configured or otherwise structured to execute that method.

Referring back to FIG. 8, flowchart 800 includes method action 810, which entails capturing sound at a first side of the recipient. In an exemplary embodiment, method action 810 is executed automatically utilizing device 610 in general, and microphone 626 in particular. In an exemplary scenario, method action 810 is executed while device 610 is located on the right side of the recipient. By way of example only and not by way of limitation, in the exemplary scenario where method action 810 is executed, device 610 corresponds to a BTE device, and the microphone 626 thereof is located on a portion thereof proximate the auricle on the right side.

That said, in an alternate embodiment, the device 610 can be held on the right side of the recipient proximate the right ear (above, in back of, in front of, etc.) via a soft band device or the like. Any placement of the microphone on one side of the recipient (e.g. the right side in this embodiment) that can enable the teachings detailed herein and/or variations thereof to be practiced can utilize in at least some embodiments. Further in this regard, any device or system that can enable the placement of the microphone on one side of the recipient that can enable the teachings detailed herein and or variations thereof can be utilized in at least some embodiments.

Flowchart 800 further includes method action 820, which entails evoking a hearing percept via bone conduction on the other side of the recipient, corresponding to the left side of the recipient in the exemplary scenario currently under description, based on the captured sound captured by the microphone on the first side (i.e. the right side in the current scenario). Method action 820 is executed in a manner such that the energy that causes the hearing percept to be evoked originates on the other side (i.e. the opposite side, the left side in the current scenario) of the recipient from that where the sound is captured (i.e., the right side in the current scenario). Accordingly, in an exemplary embodiment, method action 820 is executed automatically utilizing device 640 (or 740) or any other device that can enable a hearing percept to be evoked via bone conduction where the transducer (which originates the energy (vibrational energy that evokes the hearing percept) is located on that side of the recipient. By way of example only and not by way of limitation, in the exemplary scenario where method action 820 is executed, device 640 corresponds to a BTE device.

In alternate embodiments, method action 810 is executed with a microphone on the left side of the recipient, and method action 820 is executed with the bone conduction device, or at least the transducer thereof, on the right side of the recipient (e.g., the spatial positions of the components in the aforementioned scenario are reversed).

In a variation of the method of FIG. 8, there is an additional action of evoking a hearing percept via acoustic conduction on the second side (i.e., the opposite side from where the microphone is located) of the recipient based on the captured sound captured on the first side of the recipient. Thus, in an embodiment where the microphone is located on the right side, both a bone conduction hearing percept and an acoustic conduction hearing percept are evoked on the left side (i.e., the side opposite the microphone). In that exemplary embodiment, the acoustic conduction hearing percept is evoked by energy originating from a transducer located on the second side (the side opposite from the microphone (i.e. the left side)). By way of example only and not by way of limitation, that transducer is the same transducer that evokes a hearing percept via bone conduction. In this regard, in at least some embodiments, device 640 is configured and/or the recipient physiology is such that the transducer 643 that outputs the vibrations 644 that evoke a hearing precept via bone conduction also evokes a hearing percept via acoustic conduction. In an exemplary method, this is achieved as a result of vibrations in impinging upon the tympanic membrane on the side of the recipient where the transducer 643 is located, which is ultimately transferred to the cochlea to evoke a hearing percept. (In some embodiments, the vibrations are transferred naturally via the ossicles and/or in other embodiments, the vibrations are transferred via a prostheses). Any device, system and/or method, whether it be natural or artificial, which can enable vibrations impinging upon the tympanic membrane to evoke a hearing percept can be utilized in at least some embodiments.

In view of the above, an exemplary embodiment includes a variation of the method represented by FIG. 8, which further includes the action of evoking a hearing percept by vibrating the tympanic membrane of the recipient of the opposite side of the recipient (i.e. the opposite side from where the microphone is located or otherwise from where the sound upon which the hearing percept is based is captured).

In some embodiments, the vibrations impinging upon the tympanic membrane arrive at the tympanic membrane through the air. That is, vibration of the transducer 643 creates vibrations that travel through the air and enter the ear canal 106 and impinge upon the tympanic membrane. That said, in an alternate embodiment, vibration of the transducer 643 creates vibrations that travel through the skin and/or cartilage of the recipient and ultimately impinge upon the tympanic membrane.

In an exemplary embodiment, the system 600 in general, and the device 640 (or 740) in particular are configured to evoke hearing percepts via bone conduction at only relatively high frequencies/based on sound corresponding to only relatively high frequencies. In some embodiments, there is the system is configured to evoke hearing percepts via bone conduction based on received sound for only frequencies above about 1 kHz, 1.5 kHz, 2 kHz, 2.5 kHz, 3.0 kHz, 3.5 kHz, or 4 kHz or more and/or evoke a hearing percept based on bone conduction at those frequencies. Accordingly, in an exemplary embodiment, there is a method of evoking a hearing percept via bone conduction, which, in some embodiments, corresponds to the method action 820 of the method represented by flowchart 800 of FIG. 8, where the hearing percept evoked by bone conduction is a high-frequency hearing percept. In at least some embodiments, such an action can have utilitarian value with respect to (but not limited to) single-sided deafness. For example, ambient sound having higher frequencies originating on one side of the recipient corresponding to the side of the recipient having the ear with a hearing defect corresponding to deafness in that ear is at least sometimes "masked" by the head of the recipient with respect to the other at least partially functioning ear due to a shadow effect of the head. More particularly, in the scenario detailed above where the device 610 that includes the microphone 626 is positioned on the right side of the recipient, the microphone 626 captures sound that, in some instances (e.g., sound having high frequency content) would not be received by the ear (or at least not effectively received so as to effectively evoke a hearing percept) on the opposite side of the head (i.e. the left side) and/or would not be received by a microphone or other sound capture device (or at least not effectively received so as to effectively evoke a hearing percept) located on the opposite side of the head (i.e. the left side).

Still further, in the scenario detailed above where the device 610 that includes the microphone 626 is positioned on the right side of the recipient, the microphone 626 captures sound that, in some instances (e.g., sound having high frequency content) would be received by the ear on the opposite side of the head (i.e. the left side) with a substantially lower quality than that received by the microphone 626 and/or would be received by a microphone or other sound capture device located on the opposite side of the head (i.e. the left side) with a substantially lower quality than that received by the microphone 626. Accordingly, by capturing sound at a location (the location of the sound capture) "facing" or otherwise closer to the origination of that sound relative to the opposite side of the head, the effects of masking of the head can be effectively reduced and/or effectively circumvented/overcome. It is noted that the aforementioned scenario relates to single-sided deafness, where the ear on one side of the head is effectively non-functioning. In an alternate scenario, the ear on one side of the recipient (the side with the microphone) can simply be less functional than the ear on the other side of the recipient (the side with the vibrator). Also, in an alternate embodiment, the ear on the other side also can be less than fully functional. In an exemplary embodiment, that ear is more functional than the other ear.

Accordingly, in an exemplary embodiment, there is a method of treating single side deafness utilizing at least some of the teachings detailed herein. For example, an exemplary method action entails imparting vibrational energy into bone proximate an at least partially-functioning cochlea of a recipient. In an exemplary embodiment, vibrational energy imparted into the mastoid bone on the side of the at least partially-functioning cochlea corresponds to imparting vibrational energy into bone proximate that cochlea. In this exemplary embodiment, the vibrational energy is based on sound captured on a side of the recipient opposite the at least partially functioning cochlea. Accordingly, this exemplary method can be practiced, in at least some instances, by system 600 utilizing device 640 and/or device 740. In an exemplary embodiment of this method, the at least partially functioning cochlea can be an effectively fully functioning cochlea. In an exemplary embodiment of this method, the side of the recipient on which the sound is captured can have a fully functioning cochlea, a partially functioning cochlea, or a non-functioning cochlea, depending on the embodiment practiced. That said, in an exemplary embodiment, the cochlea of the recipient on the side of the recipient where the sound is captured is less functional than the cochlea on the side of the recipient where the vibrational energy is imparted.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A behind-the-ear device, comprising:

a vibratory portion configured to vibrate in response to an audio signal to evoke a hearing percept via bone conduction; and a speaker portion configured to evoke a hearing percept via an acoustic pressure wave.

2. The behind-the-ear device of claim 1, wherein:

the speaker portion is located on a temple mount of the behind-the-ear device.

3. The behind-the-ear device of claim 2, wherein:

the vibratory portion configured to vibrate in response to an audio signal to evoke a hearing percept via bone conduction is located away from the temple mount.

4. The behind-the-ear device of claim 1, wherein:
the vibratory portion is different in kind to the speaker portion, and wherein the behind-the-ear device includes an ear hook.

5. The behind-the-ear device of claim 1, wherein:
the speaker portion is located on a non-temple mount of the behind-the-ear device.

6. The behind-the-ear device of claim 1, wherein:
the behind the ear device is a total external device; and
the speaker is part of an in-the-ear device.

7. The behind-the-ear device of claim 1, wherein:
the behind-the-ear device is configured such that the acoustic portion is spaced away from skin of the recipient when properly worn on an ear to evoke a bone conduction hearing percept via the bone conduction portion.

8. A hearing prosthesis system, comprising:
a sound capture device configured to capture a sound and generate a signal based on the captured sound; and
a vibratory portion configured to vibrate in response to the signal to evoke a hearing percept via bone conduction, wherein
the system is configured to capture the sound on a first side of a recipient where the sound capture device is located and transfer the signal to a second side of the recipient where the vibratory portion is located, wherein
the system includes a first behind-the-ear device that includes a microphone corresponding to the sound capture device, first behind-the-ear device being located on the first side of the recipient;
the system includes a second behind-the-ear device that includes a bone conduction actuator of which the vibratory portion is part, wherein the bone conduction actuator is configured to actuate to produce the vibration to evoke the hearing percept via bone conduction by vibrating tissue comprising skin and fat covering a mastoid bone of the recipient to impart vibrations to the mastoid bone to evoke the hearing percept via bone conduction.

9. The hearing prosthesis system of claim 8, wherein:
the sound capture device is part of a contra-lateral sound capture system that includes a speaker on a same component as the sound capture device.

10. The hearing prosthesis system of claim 8, wherein:
the vibratory portion configured to vibrate in response to the signal to evoke a hearing percept via bone conduction is configured to evoke a high-frequency hearing percept.

11. The hearing prosthesis system of claim 8, wherein:
the vibratory portion is located that the sound capture device and the vibrator are located externally and on opposite sides of the recipient.

12. A hearing prosthesis system, comprising:
a sound capture device configured to capture a sound and generate a signal based on the captured sound; and
a vibratory portion configured to vibrate in response to the signal to evoke a hearing percept via bone conduction, wherein
the system is configured to capture the sound on a first side of a recipient where the sound capture device is located and transfer the signal to a second side of the recipient where the vibratory portion is located, wherein
the system includes a first behind-the-ear device that includes a first ear hook;
the system includes a second behind-the-ear device that includes a second ear hook;
the vibratory portion is part of the second behind-the-ear device; and
the sound capture device is part of the first behind-the-ear device.

13. The hearing prosthesis system of claim 12, wherein:
the system includes a passive transcutaneous bone conduction device; and
the vibratory portion is part of the passive transcutaneous bone conduction device.

14. The hearing prosthesis system of claim 12, wherein:
the system includes a bone conduction actuator of which the vibratory portion is part, wherein the bone conduction actuator is configured to actuate to produce the vibration to evoke the hearing percept via bone conduction; and
the system includes a speaker separate from the bone conduction actuator configured to evoke a hearing percept via an acoustic pressure wave based on the signal.

15. The hearing prosthesis system of claim 12, wherein:
the system includes a bone conduction actuator of which the vibratory portion is part, wherein the bone conduction actuator is configured to actuate to produce the vibration to evoke the hearing percept via bone conduction; and
the system includes a speaker separate from the bone conduction actuator configured to evoke a hearing percept via an acoustic pressure wave based on the signal, wherein
the bone conduction actuator and the speaker are supported by a same component of the system on the second side of the recipient.

16. The hearing prosthesis system of claim 12, wherein:
the system includes at least one of (i) a bone conduction device vibrator that is part of the vibratory portion or (ii) the bone conduction device vibrator that is part of the vibratory portion and a speaker;
the system includes a microphone;
the microphone is part of the sound capture device, and is located on the first side of the recipient; and
the at least one of (i) a bone conduction device vibrator that is part of the vibratory portion or (ii) the bone conduction device vibrator that is part of the vibratory portion and the speaker is located on the second side of the recipient opposite the first side of the recipient.

* * * * *